US007570894B2

(12) United States Patent
Kostyk et al.

(10) Patent No.: US 7,570,894 B2
(45) Date of Patent: Aug. 4, 2009

(54) SYSTEM FOR CONTROL OF FUSING MEMBER TEMPERATURE

(75) Inventors: Douglas J. Kostyk, Victor, NY (US); Mark W. Kruse, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 381 days.

(21) Appl. No.: 11/474,301

(22) Filed: Jun. 23, 2006

(65) Prior Publication Data

US 2007/0297825 A1 Dec. 27, 2007

(51) Int. Cl.
*G03G 15/00* (2006.01)
*G03G 15/20* (2006.01)

(52) U.S. Cl. ..... 399/45; 399/69

(58) Field of Classification Search ..... 399/45, 399/67, 69, 333
See application file for complete search history.

(56) References Cited

U.S. PATENT DOCUMENTS 3,983,287 A 9/1976 Goossen et al.
4,791,275 A 12/1988 Lee et al.
4,984,027 A 1/1991 Derimiggio et al.
5,450,183 A 9/1995 O'Leary
5,956,543 A 9/1999 Aslam et al.
6,016,409 A 1/2000 Beard et al.
6,224,978 B1 5/2001 Chen et al.
6,253,046 B1 * 6/2001 Horrall et al. ..... 399/45 X
6,611,670 B2 * 8/2003 Chen et al. ..... 399/333 X
6,799,000 B2 9/2004 Aslam et al.
6,819,886 B2 11/2004 Runkowske et al.
7,039,332 B2 * 5/2006 Suzuki ..... 399/45
7,054,572 B2 5/2006 Baruch et al.
7,072,600 B2 * 7/2006 Osaki ..... 399/67
7,269,367 B2 * 9/2007 Kwon et al. ..... 399/45

OTHER PUBLICATIONS

J. H. DuBois and F. W. John, Eds., in Plastics, 5th Edition, Van Nostrand and Rheinhold, 1974, pp. 520-521.

* cited by examiner

*Primary Examiner*—Sandra L Brase
(74) *Attorney, Agent, or Firm*—Donna P. Suchy

(57) ABSTRACT

A fuser control system and method are provided for improving the image control of printing systems, including digital front-end processors, color printers and post-finishing system. This automatic image control system, including measurement and calibration, by registering the thermal load measurements.

21 Claims, 5 Drawing Sheets

SYSTEM FOR CONTROL OF FUSING MEMBER TEMPERATURE

FIELD OF THE INVENTION

The invention relates generally to the field of printing, and more particularly to processes and apparatus for maintaining quality in digital reproduction systems by controlling the fuser used electrostatographic printing process, and in particular to the control of temperature of fusing members.

BACKGROUND OF THE INVENTION

In electrostatographic imaging and recording processes such as electrophotographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper or plastic, and the toner image is subsequently fused to the receiver in a fusing station using heat or pressure, or both heat and pressure. The fuser station can include a roller, belt, or any surface having a suitable shape for fixing thermoplastic toner powder to the receiver.

The fusing step in a roller fuser commonly consists of passing the toned receiver between a pair of engaged rollers that produce an area of pressure contact known as a fusing nip. In order to form the fusing nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used which is bonded either directly or indirectly to the core of the roller. Where the fuser member is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations having a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a DocuTech 135 machine made by the Xerox Corporation. The other uses a compliant fuser roller to form the nip against a hard or relatively non-conformable pressure roller, such as in a Digimaster 9110 machine made by Heidelberg Digital L.L.C. A fuser roller designated herein as compliant typically includes a conformable layer having a thickness greater than about 2 mm and in some cases exceeding 25 mm. A fuser roller designated herein as hard includes a rigid cylinder, which may have a relatively thin polymeric or conformable elastomeric coating, typically less than about 1.25 mm thick. A compliant fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, coated with one or more synthetic layers, which typically include polymeric materials made from elastomers.

One common type of fuser roller is internally heated, i.e., a source of heat for fusing is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller that is internally heated near its surface is disclosed by Lee et al. in U.S. Pat. No. 4,791,275, which describes a fuser roller including two polyimide Kapton® sheets (sold by DuPont® and Nemours) having a flexible ohmic heating element disposed between the sheets. The polyimide sheets surround a conformable polyimide foam layer attached to a core member. According to J. H. DuBois and F. W. John, Eds., in Plastics, 5th Edition, Van Nostrand and Rheinhold, 1974, polyimide at room temperature is fairly stiff with a Young's modulus of about 3.5 GPa-5.5 GPa (1 GPa=1 GigaPascal=10.sup.9 Newton/m.sup.2), but the Young's modulus of the polyimide sheets can be expected to be considerably lower at the stated high operational fusing temperature of the roller of at least 450 degrees F.

An externally heated fuser roller is used, for example, in an Image Source 120 copier, and is heated by surface contact between the fuser roller and one or more external heating rollers. Externally heated fuser rollers are also disclosed by O'Leary, U.S. Pat. No. 5,450,183, and by Derimiggio et al., U.S. Pat. No. 4,984,027.

A compliant fuser roller may include a conformable layer of any useful material, such as for example a substantially incompressible elastomer, i.e., having a Poisson's ratio approaching 0.5. A substantially incompressible conformable layer including a poly(dimethyl siloxane) elastomer has been disclosed by Chen et al., in the commonly assigned U.S. patent application Ser. No. 08/879,896, now U.S. Pat. No. 6,224,978, which is hereby incorporated by reference. Alternatively, the conformable layer may include a relatively compressible foam having a value of Poisson's ratio much lower than 0.5. A conformable polyimide foam layer is disclosed by Lee in U.S. Pat. No. 4,791,275 and a lithographic printing blanket are disclosed by Goosen et al. in U.S. Pat. No. 3,983,287, including a conformable layer containing a vast number of frangible rigid-walled tiny bubbles that are mechanically ruptured to produce a closed cell foam having a smooth surface.

Receivers remove the majority of heat during fusing. Since receivers may have a narrower length measured parallel to the fuser roller axis than the fuser roller length, heat may be removed differentially, causing areas of higher temperature or lower temperature along the fuser roller surface parallel to the roller axis. Higher or lower temperatures can cause excessive toner offset (i.e., toner powder transfer to the fuser roller) in roller fusers. However, if differential heat can be transferred axially along the fuser roller by layers within the fuser roller having high thermal conductivity, the effect of differential heating can be reduced.

Improved heat transfer from the core to the surface of an internally heated roller fuser will reduce the temperature of the core as well as that of mounting hardware and bearings that are attached to the core. Similarly, improved heat transfer to the surface of an externally heated fuser roller from external heating rollers will reduce the temperature of the external heating rollers as well as the mounting hardware and bearings attached to the external heating rollers.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient conformable layer. The extent of the contact area helps establish the length of time that any given portion of the toner image will be in contact with, and heated by, the fuser roller.

A fuser module is disclosed by M. E. Beard et al., in U.S. Pat. No. 6,016,409, which includes an electronically-readable memory permanently associated with the module, whereby the control system of the printing apparatus reads out codes from the electronically readable memory at install to obtain parameters for operating the module, such as maximum web use, voltage and temperature requirements, and thermistor calibration parameters.

In a roller fusing system, the fusing parameters, namely the temperature, nip-width, and speed of the fusing member, are fixed and controlled within certain specifications for a given range of receivers. Generally the system changes the temperature or/and speed according to the receiver weights or types. The changing of temperature in an internally heated fuser roller takes time to stabilize. If the receivers are presented at a too-rapid rate, the fuser roller may not have returned to its working temperature when the next receiver arrives. Consequently, the receivers must be stopped or slowed until the temperature of the fuser roller has come within acceptable range and such stopping or slowing results in degradation of receiver throughput rate. The same is true for speed changes. Regardless of whether the speed of presentation or the fuser roller temperature itself is being adjusted by the system, the temperature stabilization time required by a fusing member can constrain the speed of presentation of receivers.

The fixing quality of toned images of an electrophotographic printer depends on the temperature, nip-width, process speed, and thermal properties of the fusing member, toner chemistry, toner coverage, and receiver type. To simplify the engineering and control of a roller fusing system, as many as possible of the above parameters are considered and then fixed during the system's design. The fusing parameters such as temperature, nip-width, process speed, and thermal properties of the fusing member are optimized for the most critical case.

Complicating the system's design is the fact that the toner coverage and the receiver type (weight, coated/uncoated) can vary from image to image in a digital printer. Therefore, some of the above listed parameters need to be adjusted according to the image contents and the receiver types to assure adequate image fixing. Typically, the fuser temperature is adjusted and kept constant for a dedicated run with a particular receiver. The temperature is adjusted higher from the nominal, for heavier receivers and lower for lighter receivers. For some heavy receivers, the speed must also be reduced.

The change of fuser temperature and/or reduction of speed results in reduced productivity. Furthermore, if different receiver types are required in a single document, extra time is needed to collate images on different receivers into the document.

A digital printer with multiple paper supplies allows running RIPPED information that varies from image to image onto multiple receivers in a single document run. Since the RIPPED image may vary from one occurrence to the next, both in image color and image density, the workload on the fuser may vary significantly. U.S. Pat. No. 5,956,543, issued to Aslam et al. optimizes the image fixing of toned images on a specified receiver by optimally selecting the fuser temperature, nip-width and speed. However, it does not address the image fixing quality issues when multiple types and weights of receivers are mixed during a document mode operation of an electrophotographic printer.

The present invention overcomes this shortcoming by making fuser temperature control more efficient and accurate and allowing it to occur automatically during the printing run. The following invention solves the current problems with fuser temperature control in a wide variety of situations.

SUMMARY OF THE INVENTION

In accordance with an object of the invention, both a system and a method are provided for improving the temperature control of a fuser in a printing system, and specifically the efficiency and accuracy of the fuser control. More specifically, the invention relates to the use of a system to control the transfer of heat rapidly to a fuser roller in an electrophotographic printer and the resulting fuser temperature based on a number of factors including receiver type and fuser temperature. The invention uses stored media process set points, input image content, and input media type data to regulate the heat transfer rate by varying the nip width between the fuser roller and the receiver. The adjustments are sufficiently rapid and accurate that the invention allows for the printing of many different media weights and types in a print run without restrictions on media run lengths, without collation requirements per run, and without productivity losses due to slowing of feed rate for heavier receivers. One embodiment of this method includes the automatic adjustment of thermal load measurements for use in a receiver catalogue.

While the specification concludes with claims particularly pointing out and distinctly claiming the subject matter of the present invention, it is believed the invention will be better understood from the following detailed description when taken in conjunction with the accompanying drawings.

BRIEF DESCRIPTION OF THE DRAWINGS

For a better understanding of the characteristics of this invention the invention will now be described in detail with reference to the accompanying drawings, wherein.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art.

Various aspects of the invention are presented in FIGS. 1-7 which are not drawn to scale and in which like components are numbered alike. According to one aspect of the invention, the thermal response of the fuser with sheets being fed through the fuser is simulated in the fuser prior to feeding sheets through the fuser. The thermal response may be simulated in a manner that minimizes thermal droop, or it may be simulated in a manner that maintains a tentering force, or it may be simulated in a manner that accomplishes both. According to a further aspect of the invention, the thermal response of the fuser with sheets being fed through the fuser is controlled to maintain a desired tentering force. The desired tentering force may be varied based on sheet width, or sheet heat absorbing capacity, or sheet stiffness, or combinations of these (all combinations thereof being included within the purview of the invention).

Figure 1:
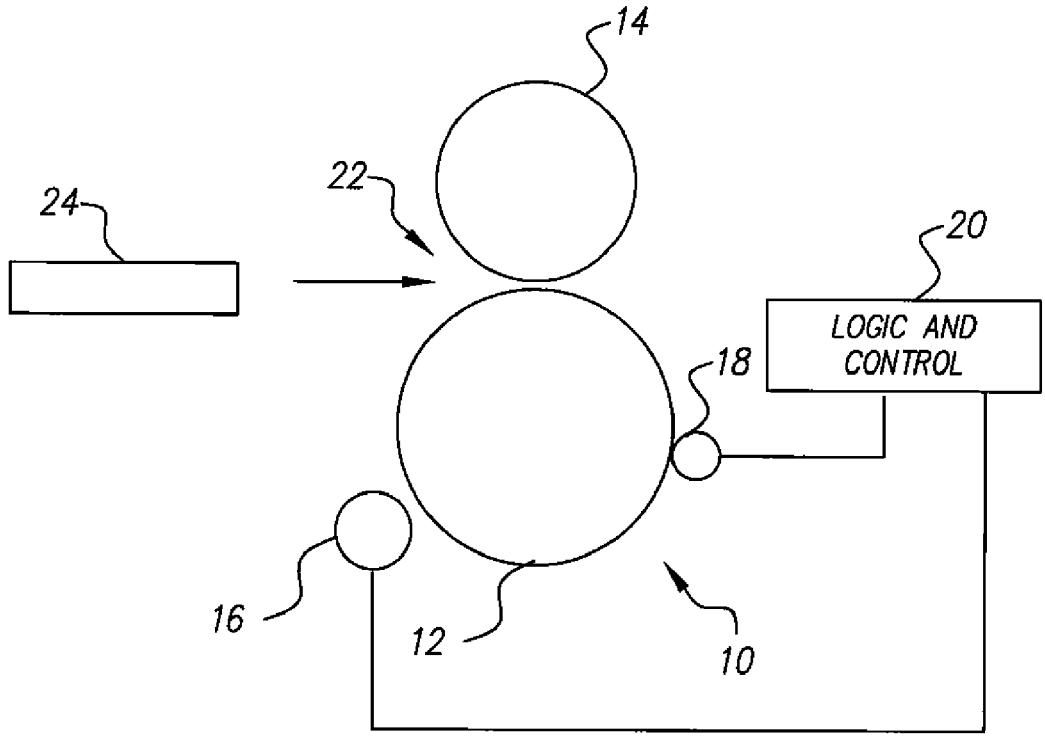
FIG. 1 is a schematic illustration of a printer system according to the present invention for use in conjunction with a image control system and method.

FIG. 1 shows a fuser 10 including a fuser roller 12 and a pressure roller 14. The fuser 10 further has a fuser roller heater 16, and a fuser temperature sensor 18, which inputs to a logic and control system 20, also referred to as a Logic Control Unit (LCU), that controls the heating of the fuser roller heater 16. The fuser 10 has a run condition, and an idle condition. The fuser roller 12 and the pressure roller 14 form a nip 22. A receiving sheet, also referred to as a receiver, 24 is considered to have entered the fuser 10 when it has entered the nip 22. The heater 16 may be electrothermal, radiative, convective, or other heat source suitable for fusing images, internal or external to the fuser roller, the particular type of heat source not being critical in the practice of the invention.

According to an aspect of the invention, an improved method of operation of a fuser 10 for fixing toner images to a receiver 24 includes controlling the thermal load in conjunction with the fuser roller 12 prior to the receiver entering the fuser 10, by using the logic and control system 20 to activate the fuser roller heater 16 in response to information contained in the LCU 20. By performing a run (virtual or real) including fusing the toner to the sheet of receiver media by a fusing member during an interframe interval before the arrival of each receiver, wherein the nip width between the external heating rollers and the internally heated roller are adjusted to vary the amount of heat and the resulting temperature related information used to set a new thermal set point and stored for future runs.

This helps prevent thermal droop because it eliminates the lag time between the arrival of the receiver 24 and the activation of the fuser roller heater 16.

Figure 2:
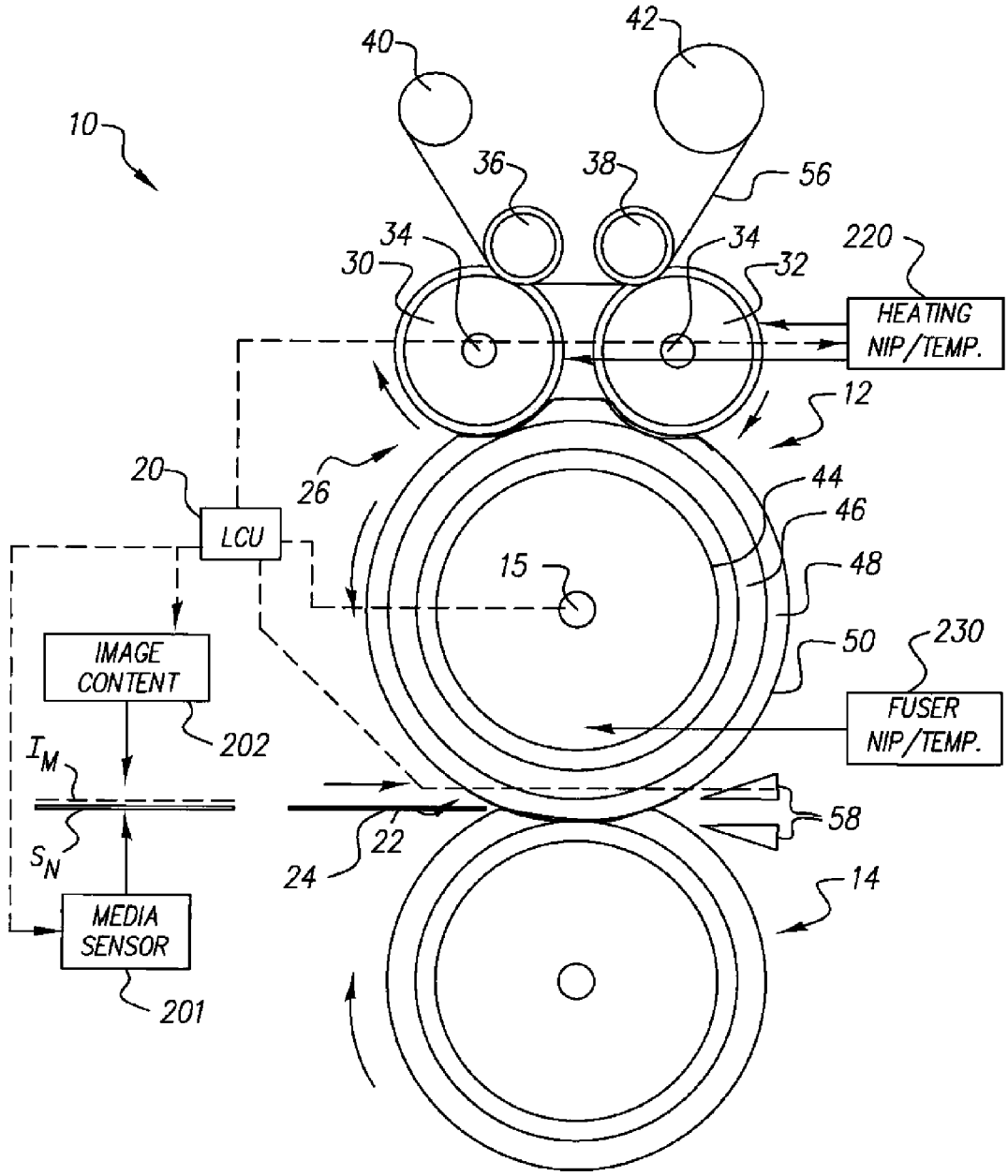
FIG. 2 is a schematic diagram of the fuser assembly according to this invention.
Figure 3:
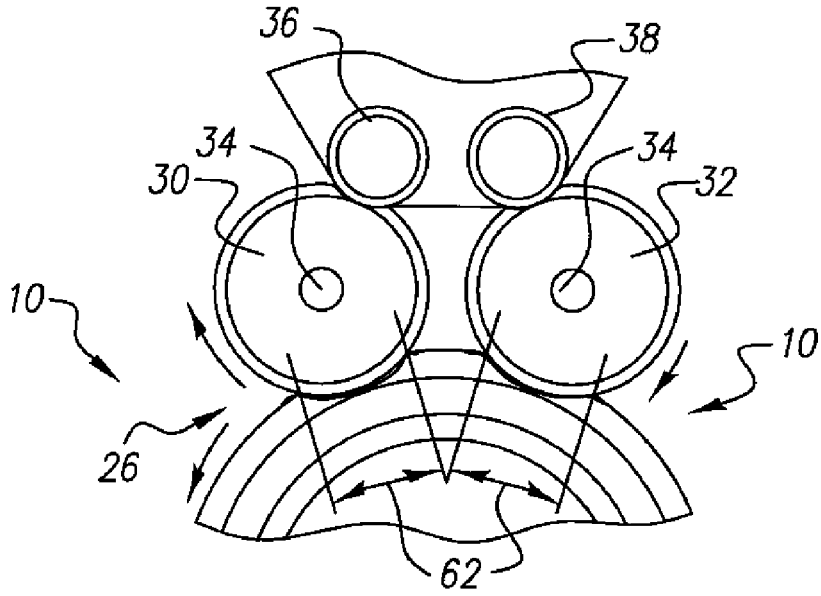
FIG. 3 is a schematic diagram showing the heating rollers and the fuser roller, and the nips between them, for the fuser assembly of FIG. 2.
Figure 4:
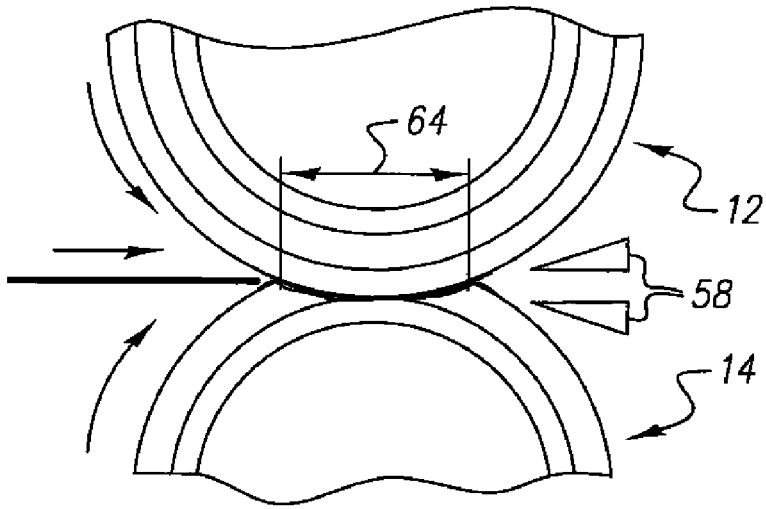
FIG. 4 is a schematic diagram showing the fuser roller and the pressure roller, and the nip between them, for the fuser assembly of FIG. 2.
Figure 5:
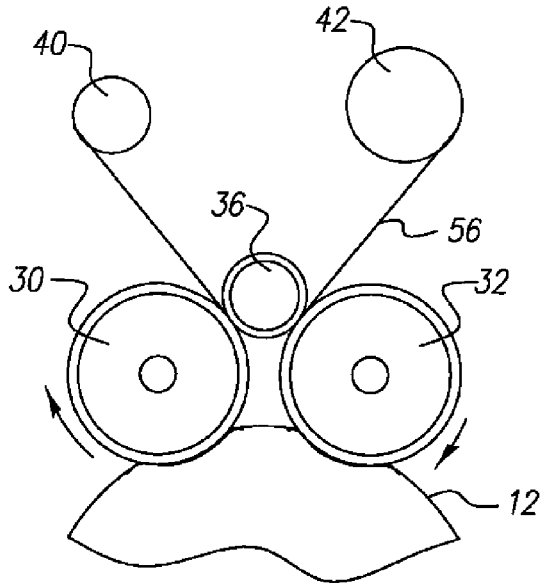
FIG. 5 is a schematic diagram showing a fuser roller with a single backup roller.

A schematic diagram of one fuser assembly disclosed in this invention is shown in FIG. 2. The fuser assembly includes a fuser roller 12 and a pressure roller 14. Fuser roller 12 is heated with an internal heat source 16 (lamp) and external heating rollers 30 and 32 that make up a nip 26 with fuser roller 12. The number and sizes of external heating rollers and the sizes of the fuser roller 12 and pressure roller 14 depend on the printer process speed and the heat requirements for proper image fixing. Any toner or paper dust contamination on the heating members 30 and 32 is cleaned with a cleaning web 56 trained around takeup and supply rollers 40 and 42 respectively and corresponding back up rollers 36 and 38. In alternative embodiments, the cleaning is accomplished by other mechanisms well known in the art, such as blade cleaning or tacky rollers for example.

The receiver (sheet) release from the fuser roller 12 and pressure roller 14, is accomplished by a pair of air knives 58. In alternative embodiments of the invention, mechanical pawls or skive fingers for example, are utilized for receiver stripping, replacing the air knives. Further, toner offset prevention is accomplished by application of a release fluid to the fusing member rollers. The release fluid applicator is not shown in the diagram, but either a donor roller type or a web type applicator may be employed.

The fuser roller 12 includes an aluminum core 44, an elastomeric base-cushion 46 (relatively more compliant than the pressure roller), a conductive elastomeric intermediate layer 48 (5 to 10 mm (mils)) thick depending on the process speed), and finally a thin (1-2 mm (mils)) top release coating 50. The external heating rollers 30, 32 are conductive metallic (steel, aluminum, etc.) cores with a finished metalized hard surface such as chrome, nickel, anodized aluminum, etc. Other embodiments of the external heating rollers use conductive Teflon® based coatings on the respective conductive cores.

The external heating rollers 30, 32 are heated with internal lamps 34. A predetermined desired temperature of fuser roller 12 is maintained by an internal heat lamp 16 during the standby mode when external heating rollers 30, 32 are not engaged. The heat input for fusing of toner comes mainly from external heating rollers 30, 32 to the fuser roller 12 during the print mode. A limited amount of additional heat comes from the fusing roller's internal heat source 16 as a thermal ballast during the print mode to keep the core of the fuser roller 12 within the desired predetermined temperature range.

Figure 7:
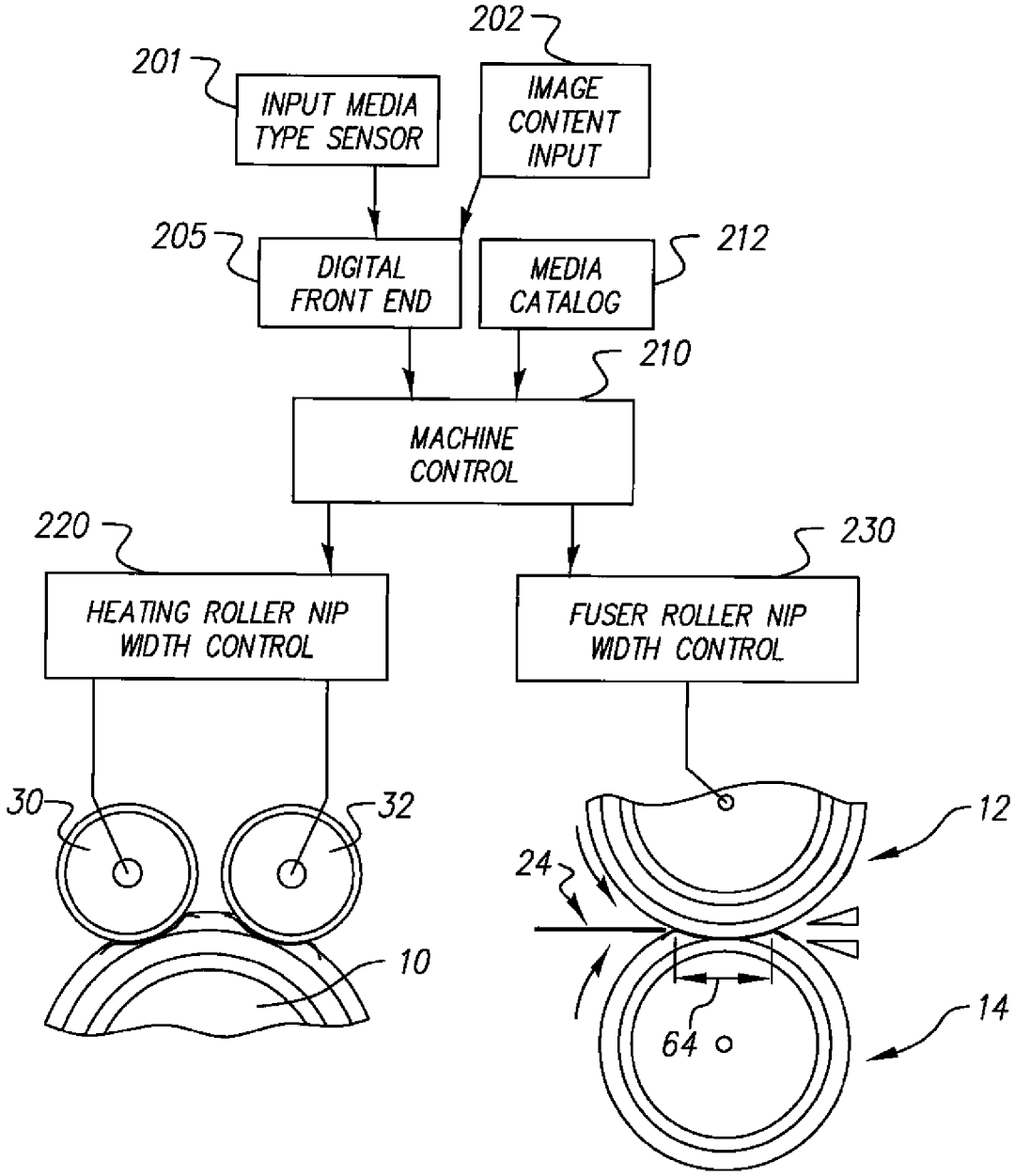
FIG. 7 is a block diagram of the fuser control mechanism according to this invention, illustrating the process steps according to one embodiment of the invention.

A sheet $S_n$ bears a toner image $I_n$. As indicated in FIG. 7, the toner content of the image and the type of media that receives the image are provided to the digital front end 205 (hereafter referred to as DFE) associated with the printer. The digital front end 205 and media catalog 212 provide the printer machine control 210 with signals representing respectively image content, and type of media and parameters of such media type being used. For quality control purposes, the apparatus has a media sensor 201 that senses the type and weight of the sheet $S_n$ and an image content sensor 202 senses the amount of toner that forms the image, $I_n$. The heating roller controller 220, associated with the machine control 210, controls the nip between heating rollers 30, 32 and 12 as well as the temperature of each heating roller 30, 32. The fuser roller nip width controller 230, associated with the machine control 210, controls the temperature of roller 12 and the nip between rollers 12 and 14.

Figure 6:
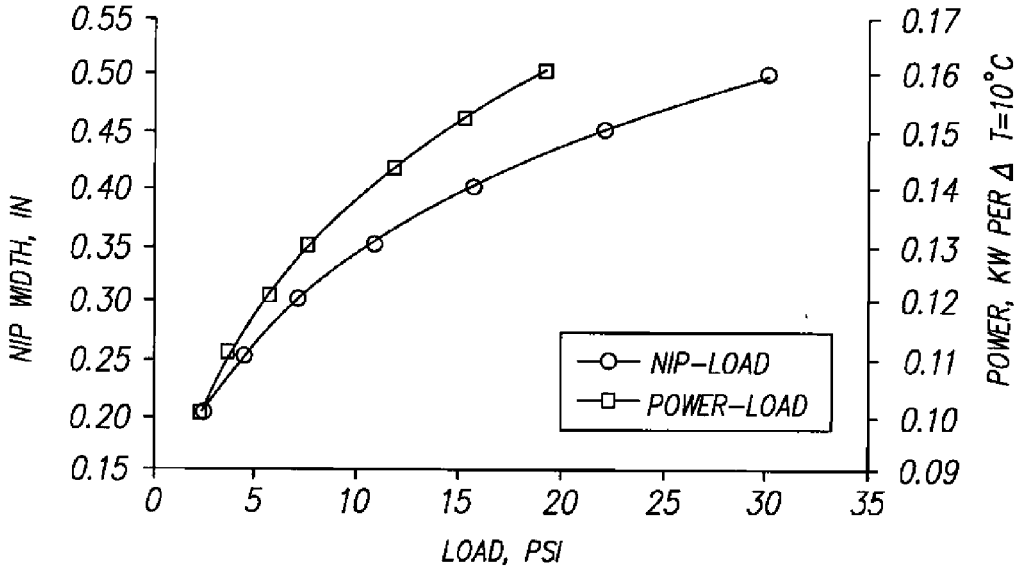
FIG. 6 is a graph showing the relationship between the applied load and nipwidth, according to this invention, giving the power transferred at different levels of load.

The fuser assembly according to this invention adjusts the fuser member roller 12, temperature to various set points by changing the nip width 62 (see FIG. 3) or contact time between the heating rollers 30, 32 and the fuser member roller. The temperature of the heating rollers 30 and 32 is maintained constant, but the heat input to the fuser roller 12 is controlled by the heating roller nip width (dwell time) 62 between the heating rollers and the fuser member roller. The graph of FIG. 6 shows an example of the relationship between the applied load and nipwidth and corresponding power that can be transferred to the fuser roller for every 10.degree. C. temperature difference between the heating rollers and the fuser roller.

The fuser assembly according to this invention also applies print engine intelligence as referred to above. The fuser process set points (fuser nipwidth, fuser member temperature, and energy requirements) for various types of media are stored as lookup tables in a media catalog 212 for the machine control unit 210 (see FIG. 7). The media can include heavy stock cover material, interior page print material, insert material, transparency material, or any other desired media to carry text or image information. A typical machine control unit 210 includes a microprocessor and memory or microcomputer. It stores and operates a program that controls operation of the machine in accordance with programmed steps and machine inputs, such as temperature of the fusing rollers. Temperature data is supplied, for example, by a thermocouple (not shown) or any other suitable thermal sensor in a manner well known to those skilled in the art. As a sheet of a specific media type is requested, the DFE 205 provides a data signal to the machine control unit 210 (or alternatively, directly to an independent control for the fuser assembly) that is representative of the image contents and the type of media sheet coming to be fixed. The machine control unit 210 sets the fuser conditions (temperature; dwell time) from the media catalog 212 as a function of the data provided by the DFE 205. Machine control unit 210 directs the heating roller nip width control 220 for heating rollers 30, 32 to adjust the nipwidth 62 according to the power requirements of the fuser roller 12 per the information provided from media catalog 212. Machine control unit 210 also directs the fuser roller nip width controller 230 for fusing roller 12 and pressure roller 14 to adjust the fuser nip 64 per the information provided from media catalog 212.

The energy in the fuser roller 12 is stored only in its top coating and the conductive intermediate layer (5-10 mm (mils)). See FIG. 4 and FIG. 7. Therefore, after the passage of each sheet through the fuser nip 22, the fuser surface temperature drops significantly and heat energy needs to be restored back in the fuser roller 12 by the heating rollers 30, 32 during their contact time. Since the heating rollers 30, 32 are made of thermally conductive materials; the heat transfer rate to the fuser roller 12 is fast. As one media type is followed by a different media type, the machine control unit 210 is informed of the different types and it loads the corresponding fuser setup conditions from the media catalog 212. Consequently the fuser nip 22, as well as fuser roller temperature (driven by the nipwidth 62) is adjusted to the correct value during the inter-frame between two sheets. Both controllers 220 and 230 change the respective nips 26 and 22 dynamically, in any well-known manner, during the inter-frame between two sheets.

Each nip control may include a cam and a stepper motor for a fixed displacement nip, a set of air regulated cylinders for constant load nip, a combination of both, or any combination of these and other electromechanical mechanisms well-known in the art. Since the temperature of the fusing roller (as driven by the heating rollers nip) and the nipwidth between the fusing and pressure members can be manipulated and adjusted for each sheet, such a fusing assembly system allows mixing of many different media weights and types seamlessly without any restriction on the run length of each media.

In distinct embodiments of the invention, the fusing member may be in the form of a roller, a belt or a sleeve, or variations thereof as are well known in the art.

In a further embodiment of the invention (see FIG. 5), the cleaning web 56 may be placed in contact with the external heating rollers 30, 32 using only a single back up roller 36.

The invention confers the advantage of enabling the printer to run jobs in document mode while mixing a variety of receivers, without loss of productivity or fusing quality. The invention also facilitates seamless printing on the widest possible ranges of media types and weights.

When the system detects a thermal load difference, that is a difference between a stored or expected, target thermal load and a detected thermal load that is different then expected then additional steps can be taken. The detected thermal load is first compared to the thermal load values, or thermal load related values, stored in the LCU, for that receiver, as discussed above. If the thermal difference exceeds a threshold amount (for that receiver and print job type) then the system will alert, through a reply function, the operator or system and suggest a new value that can be utilized in subsequent runs. This function would be implemented in conjunction to the embodiments described above or as a stand-alone method and a signal can be generated if the thermal load difference is above the threshold amount Although it could be partially automated it is important that the operator is able to override any such alert since the alert could be due to a desired change in the receiver and is preferably an alert system and method.

Those skilled in the art understand that the functional elements of the sensors 201, 202 and the controllers 220, 230 may be implemented in different ways. In lieu of actual sensors, the machine may be pre-set for specific media types, weights and toner content. Likewise, the controllers 220, 230 may use electric stepper motors, hydraulics or pneumatic operators and other equivalent means to move the rollers and set the nips.

The invention has been described in detail with particular reference to certain preferred embodiment thereof, but it will be understood that variations and modifications can be effected within the spirit and scope of the invention.

PARTS LIST Fuser 10) fuser roller 12) pressure roller 14) fuser roller heater 16) fuser temperature sensor 18) LCU 20) Nip (12& 14) 22) receiver 24) Nip (30, 32 and 12) 26) external heating roller 30&32) back up rollers 36, 38) supply rollers 40, 42) aluminum core 44) elastomeric base cushion layer 46) elastomeric intermediate layer 48) top release coating 54) cleaning web 56) pair air knives 58) external heating roller nip width 62) fuser nip 64) media sensor 201) image content sensor 202) digital front end (DFE) 205) machine control unit 210) media, which could be the difference between the target and detected thermal load catalog 212) heating roller controller 220) fuser roller nip width controller 230).

The invention claimed is:

1. An electrostatographic printer with a fusing apparatus, including an apparatus for maintaining print quality based on temperature measurements, said apparatus comprising:

a. a heated fusing member, including a power supply for controlling temperature of the fuser, for fusing toner to sheets of receiver media;

b. one or more measurement devices to measure temperature-related information;

c. a pressure member in contact with the heated fusing member to form a fusing nip there between;

d. a machine controller for changing fusing nip widths in accordance with the type of receiver media and the image on the media;

e. a heating member controller associated with the machine controller, for changing temperature of the heated fusing member;

f. a pressure member nip controller associated with the machine controller, for changing nip width between the pressure member and the heated fusing member;

g. a processing system device for calculating a quality adjustment range based on current process measurements and a thermal load related set-point, or a derivative thereof, indicative of print quality;

h. a comparator wherein a first information, or a derivative thereof, is compared to the calculated quality adjustment range, or a derivative thereof, indicative of print quality;

i. an adjuster to adjust the current conditions so they trend towards a new thermal load set point within the quality adjustment range in a controlled manner; and j. a controller for controlling the temperature based on the comparison based on the comparator and/or the adjuster.

2. The apparatus of claim 1, further comprising one or more external heating members.

3. The apparatus of claim 1, wherein the external heating members are rollers, which contain an internal heating source.

4. The apparatus of claim 1, wherein the fusing member comprises an internally heated fuser roller.

5. The apparatus of claim 1, wherein said internally heated fuser roller comprises: an aluminum core; an elastomeric base-cushion; a conductive elastomeric intermediate layer; and a thin top release coating.

6. Method for maintaining print quality based on temperature measurements for a fuser for fusing toner to sheets of receiver media in an electrostatographic printer, comprising for each dedicated run of the specified substrate, the steps of:

a. providing a first data set, including set points representative of one or more types of receivers;

b. providing a second data set representative of a particular type of arriving receiver, including receiver type;

c. providing third data set representative of the current thermal set-points related to the current set-up, including current substrate type;

d. selectively adjusting pressure between a receiver media and the fusing member in accordance with at least one of the data sets;

e. performing a run including fusing the toner to the sheets of receiver media by a fusing member including one or more internally heated rollers heated by one or more external heating rollers, before the actual run, wherein the nip width between the external heating rollers and the internally heated roller are adjusted to vary the amount of beat transferred from the external heating rollers to the internally heated roller; and stripping the sheet of receiver media from the fusing member; and f. using the resulting temperature related information to calculate a fourth data set including a new thermal set point

7. Method of claim 6, wherein the fourth data set, including a new thermal set point, is stored in the substrate catalogue to be used as a temperature control based on substrate type and fuser temperature.

8. The method of claim 6, wherein the run comprises printing a 50-250 receiver sheets, to reach a steady-state situation, before taking the measurements representing the thermal load and storing these measurements in the substrate catalog.

9. The method of claim 6, wherein the run comprises printing a virtual run to simulate a real run of 50-250 receiver sheets, to reach a steady-state situation, before taking the measurements representing the thermal load and storing these measurements in the substrate catalog.

10. The method of claim 6, further comprising:

a. comparing the current and new temperature set-point measurements to calculate a difference;

b. calculating a quality adjustment thermal range based on current process measurements, including temperature and substrate type, or a derivative thereof, indicative of print quality;

c. adjusting current process conditions related to the current process measurements, including temperature and substrate type, or a derivative thereof, to trend towards the new set point within the quality adjustment range so that a rate of change is proportional to the difference between the current process measurements and the set point; and d. controlling the temperature based on the comparison.

11. Method of claim 10, wherein the quality adjustments range has a minimum and maximum.

12. Method of claim 10, wherein the adjustment is made at a controlled rate of change and the controlled rate of change is optimized based on a set of rules that are chosen based on current process conditions.

13. Method of claim 10, wherein the temperature control is based on substrate type and fuser temperature.

14. Method for maintaining print quality based on temperature measurements for a fuser for fusing toner to sheets of receiver media in an electrostatographic printer, comprising for each arriving sheet of receiver media the steps of:

a. providing a set of first data signals respectively representative of characteristics of sheets of receiver media, including receiver type;

b. providing second data signals representative of a particular type of sheet of arriving receiver media so that a selection can be made of corresponding first data signals;

c. providing third data signals representative current thermal set-point related to substrate type;

d. selectively adjusting pressure between a receiver media and the fusing member in accordance with at least one of the second or third data signals;

e. performing a run including fusing the toner to the sheets of receiver media by a fusing member including one or more internally heated rollers heated by one or more external heating rollers, during an interval before the actual run, wherein the nip width between the external heating rollers and the internally heated roller are adjusted to vary the amount of heat transferred from the external heating rollers to the internally heated roller; and stripping the sheet of receiver media from the fusing member; and f. using the resulting temperature related information to calculate a new thermal set point.

15. The method of claim 14, wherein the run comprises printing a 50-250 receiver sheets, to reach a steady-state situation, before taking the measurements representing the thermal load and storing these measurements in the substrate catalog.

16. The method of claim 14, wherein the run comprises printing a virtual run to simulate a real run of 50-250 receiver sheets, to reach a steady-state situation, before taking the measurements representing the thermal load and storing these measurements in the substrate catalog.

17. The method of claim 14, further comprising:

a. comparing the current and new temperature set-point measurements to calculate a difference;

b. calculating a quality adjustment thermal range based on current process measurements, including temperature and substrate type, or a derivative thereof, indicative of print quality;

c. adjusting current process conditions related to the current process measurements, including temperature and substrate type, or a derivative thereof, to trend towards the new set point within the quality adjustment range so that a rate of change is proportional to the difference between the current process measurements and the set point; and d. controlling the temperature based on the comparison.

18. The method of claim 17 wherein a signal is generated if a thermal load difference is above a threshold amount

19. Method of claim 17, wherein the quality adjustments range has a minimum and maximum.

20. Method of claim 17, wherein the adjustment is made at a controlled rate of change and the controlled rate of change is optimized based on a set of rules that are chosen based on current process conditions.

21. Method of claim 17, wherein the temperature control is based on substrate type and the fuser temperature

* * * * *